US010293397B2

(12) United States Patent
Tokutomi et al.

(10) Patent No.: US 10,293,397 B2
(45) Date of Patent: May 21, 2019

(54) METAL WIRE AND ELECTRIC WIRE

(71) Applicants: Yazaki Corporation, Tokyo (JP); The University of Tokyo, Tokyo (JP)

(72) Inventors: Junichiro Tokutomi, Susono (JP); Kenichi Hanazaki, Susono (JP); Jun Yanagimoto, Tokyo (JP)

(73) Assignees: Yazaki Corporation, Tokyo (JP); The University of Tokyo, Tokyo (JP)

( * ) Notice: Subject to any disclaimer, the term of this patent is extended or adjusted under 35 U.S.C. 154(b) by 478 days.

(21) Appl. No.: 14/495,138

(22) Filed: Sep. 24, 2014

(65) Prior Publication Data

US 2015/0017058 A1 Jan. 15, 2015

Related U.S. Application Data

(63) Continuation-in-part of application No. PCT/JP2013/058726, filed on Mar. 26, 2013.

(30) Foreign Application Priority Data

Mar. 29, 2012 (JP) ..... 2012-075821

(51) Int. Cl.
*B21F 9/00* (2006.01)
*H01B 1/02* (2006.01)
(Continued)

(52) U.S. Cl.
CPC ..... *B21F 9/005* (2013.01); *B21C 1/003* (2013.01); *B21C 19/00* (2013.01); *B21F 99/00* (2013.01);
(Continued)

(58) Field of Classification Search
CPC ..... B21C 19/00; B21C 1/003; B21F 99/00; B21F 9/005; C21D 1/02; C21D 7/02;
(Continued)

(56) References Cited

U.S. PATENT DOCUMENTS 3,326,025 A * 6/1967 Nishioka ..... B21C 1/02 72/161
2008/0213589 A1 9/2008 Hanazaki et al.
(Continued)

FOREIGN PATENT DOCUMENTS

JP 58-144451 A 8/1983
JP 01-317616 A 12/1989
JP 2008-218176 A 9/2008

OTHER PUBLICATIONS

Office Action dated Jun. 3, 2016, issued for the Japanese patent application No. 2012-075821 and English translation thereof.
(Continued)

*Primary Examiner* — Jenny R Wu
(74) *Attorney, Agent, or Firm* — Locke Lord LLP

(57) ABSTRACT

To provide a metal wire and an electric wire of high mechanical strength and high ductibility that have sufficiently increased ductibility as well as sufficiently increased mechanical strength. A metal wire manufactured at least by being subjected to an extension in which a metal wire is extended in an axial direction, and having a hardness distribution in which hardness decreases toward a specific peripheral portion from a central portion in a cross-section orthogonal to axis, whereby a softened peripheral portion becomes to show a good malleability as well as a high resistance to cracking, so as to attain an improvement of mechanical strength and ductibility.

7 Claims, 3 Drawing Sheets

(51) Int. Cl.

| | |
|---|---|
| ***C22F 1/00*** | (2006.01) |
| ***C22F 1/04*** | (2006.01) |
| ***C22F 1/08*** | (2006.01) |
| ***B21F 99/00*** | (2009.01) |
| ***B21C 1/00*** | (2006.01) |
| ***B21C 19/00*** | (2006.01) |
| ***C21D 7/02*** | (2006.01) |
| ***C21D 7/10*** | (2006.01) |
| ***C21D 1/02*** | (2006.01) |

(52) U.S. Cl.
CPC ..... *C21D 1/02* (2013.01); *C21D 7/02* (2013.01); *C21D 7/10* (2013.01); *C22F 1/00* (2013.01); *C22F 1/04* (2013.01); *C22F 1/08* (2013.01); *H01B 1/023* (2013.01); *H01B 1/026* (2013.01)

(58) Field of Classification Search
CPC ..... C21D 7/10; C22F 1/00; C22F 1/04; C22F 1/08; H01B 1/023; H01B 1/026; B21D 7/08
See application file for complete search history.

(56) References Cited

U.S. PATENT DOCUMENTS

2010/0116012 A1* 5/2010 Hermes ..... B21D 7/08 72/166
2017/0196614 A1* 7/2017 Crawford ..... A61B 17/8863

OTHER PUBLICATIONS

Office Action dated Jan. 27, 2016, issued for the corresponding Chinese patent application No. 201380018164.0 and English translation thereof.
International Search Report dated Jul. 2, 2013, issued for PCT/JP2013/058726.

* cited by examiner

METAL WIRE AND ELECTRIC WIRE

TECHNICAL FIELD

The present invention relates to a metal wire and an electric wire, and also relates to a metal wire produced by at least being subjected to a drawing in which a metallic material is extended in an axial direction, and an electric wire including one or more of the metal wires.

BACKGROUND ART

Conventionally, a conductive metal wire (element wire) have been used as a material for electric wire and the like, and a drawing is known as a manufacturing method of the metal wire, where a metallic material is extended to be thin through dies while being stretched in an axial direction (for example, refer to PTL 1). The patent literature 1 describes a manufacturing method in which a conductive material is subjected to a typical drawing and is extended, thereafter a bending where the conductive material is bent (secondary processing) is performed. The element wire obtained by such bending has an increased mechanical strength due to a change of crystal grains contained in a conductor into fine isometric grains.

CITATION LIST

Patent Literature

[PTL 1]
JP-A-2008-218176

SUMMARY OF INVENTION

Technical Problem

However, the metal wire obtained by the conventional manufacturing method as described in patent literature 1 has sufficient mechanical strength, but an improvement of ductibility thereof remains insufficient. Thus, a development of a metal wire having further improved ductibility is demanded.

The present invention aims to provide a metal wire and an electric wire of high mechanical strength and high ductibility having sufficiently improved mechanical strength as well as sufficiently improved ductibility.

Solution to Problem

In order to achieve the above objectives, the inventors of this application have come to discover a strong correlation between a hardness distribution of a metal wire in cross-section orthogonal to axis and ductibility thereof and the metal wire having high mechanical strength and high ductibility can be realized by imparting a proper hardness distribution thereto.

In accordance with a first aspect of the present invention, a metal wire comprises a hardness distribution in which hardness decreases toward a specific peripheral portion in a specific radial direction from a central portion in a cross-section orthogonal to an axis, wherein the metal wire is manufactured at least by subjecting a metallic material to an extension in an axial direction.

In the first aspect of the present invention, it is preferable that hardness of the specific peripheral portion decreases by equal to or more than 10% of hardness of the central portion at a circumferential surface side being beyond at least ½ of the radius from the center.

In the first aspect of the present invention, it is preferable that hardness of an opposing peripheral portion that opposes to the specific peripheral portion in a radial direction with reference to the central portion falls within plus and minus 10% of the hardness of the central portion, and the hardness of the opposing peripheral portion is higher than the hardness of the specific peripheral portion.

In the first aspect of the present invention, it is preferable that the hardness of the peripheral portion in the radial direction after the extension is higher than the hardness of the central portion, and the hardness of the specific peripheral portion becomes less than the hardness of the central portion by means of a secondary processing performed after the extension.

In the first aspect of the present invention, it is preferable the hardness of the central portion after the secondary processing is higher than the hardness of the central portion before the secondary processing, and the hardness of the specific peripheral portion after the secondary processing decreases by more than 10% with reference to the hardness of the specific peripheral portion before the secondary processing.

In accordance with a second aspect of the present invention, an electric wire comprises one or more of the metal wire of the first aspect of the present invention.

Advantageous Effects of Invention

According to the first aspect of the present invention, by having a hardness distribution in which hardness decreases toward a specific peripheral portion from a central portion in a radial direction, a drastic improvement of ductibility can be attained. Here, the specific peripheral portion may be a restricted area in a circumferential direction (e.g., a sector having a center angle of approximately 30 to 90 degrees) in cross-section orthogonal to axis, may be a wider area (e.g., 30 to 180 degrees) than that, or may be an area of approximately entire circumference. As compared with such the metal wire of the present invention, a conventional metal wire to which a typical drawing is merely processed has a hardness distribution in which the hardness of the peripheral portion is higher than the hardness of the central portion. Hence, in the conventional metal wire, although an improvement of mechanical strength can be attained, a sufficient ductibility cannot be attained because the peripheral portion of high hardness thereof is prone to get brittleness. In contrast, the metal wire of the present invention, by having the hardness distribution in which the hardness of the peripheral portion is less than the hardness of the central portion, the softened peripheral portion becomes to show a good malleability as well as a high resistance to cracking, thereby attaining an improvement of ductibility.

According to the preferred aspect of the present invention, the hardness of the specific peripheral portion decreases by equal to or more than 10% with reference to the hardness of the central portion at the periphery side surpassing at least ½ of the radius from the center portion. That is, due to the hardness being equal to or less than 90% with reference to the hardness of the central portion, over half of the region in the specific radial direction can be the specific peripheral portion, and an improvement of ductibility of the metal wire can be more assuredly attained with the softened peripheral portion.

According to the preferred aspect of the present invention, by including the opposing peripheral portion of hardness falling within plus and minus 10% of the hardness of the central portion and the hardness being higher than the specific peripheral portion, and by having the hardness distribution showing non-uniform hardness in between the specific peripheral portion side and the opposing peripheral portion side across the central portion, that is, the hardness distribution being asymmetric with reference to the central axis in the cross-section orthogonal to axis, the mechanical strength and the ductibility of the metal wire can be improved with well-balance.

According to the preferred aspect of the present invention, by subjecting a metallic material having obtained hardness higher in the peripheral portion than in the central portion in the radial direction after the drawing to the secondary processing, an improvement of ductibility can be attained by softening particularly the specific peripheral portion among the peripheral portions that have been hardened by the drawing.

According to the preferred aspect of the present invention, by performing the secondary processing to increase the hardness of the central portion as well as to decrease the hardness of the specific peripheral portion by equal to or more than 10% from the hardness before the secondary processing, the mechanical strength as well as the ductibility of the metal wire can be improved.

According to the preferred aspect of the present invention, due to the electric wire being configured with the metal wire of improved ductibility as described above, a breaking of the metal wire can be prevented when manufacturing an electric wire. In particular, when configuring an electric wire with a twisted wire made by twisting a multiple metallic lines, due to the prevention of breaking while twisting, the production efficiency and the yield of the metal wire can be improved, so that the cost of manufacturing can be reduced.

DESCRIPTION OF EMBODIMENTS

Figure 1:
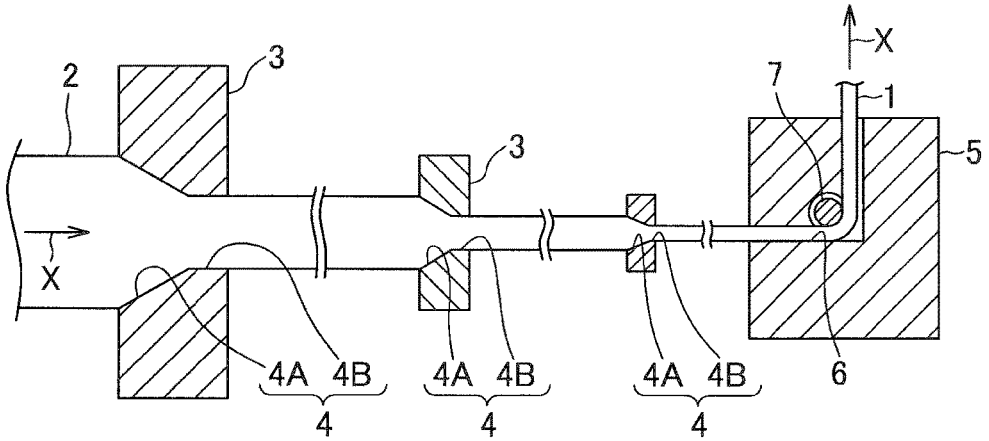
FIG. 1 is a cross-sectional view of a manufacturing method of a metal wire according to one embodiment of the present invention.

A metal wire according to one embodiment of the present invention will be described in accordance with FIG. 1 to FIG. 4B. A metal wire 1 of the present embodiment is used as an element wire for an electric wire. As for the electric wire, such as a single wire made of a single metal wire 1 being covered with electrically insulating coating, a twisted wire made by twisting a plurality of metal wires 1 and covered with electrically insulating coating, and a braided wire used for a coaxial cable, a shielded cable or the like may be exemplified. Such the electric wires are used as wire harness that connects between electronic appliances mounted on automobiles or used as powerlines connected to batteries and generators. As such, the applications thereof are not specifically limited. Also, as for the metal wire 1, such as copper, an annealed copper wire made of copper alloy, a tinned copper wire or a nickel-plated copper line, and an aluminum wire or an aluminum alloy wire or the like made of aluminum or aluminum alloy may be exemplified.

The metal wire 1 is manufactured from a metallic material 2 by subjecting the metallic material 2 to drawing as primary processing and bending as next processing. First, in the drawing, by using a plurality of dies 3 (three for the present embodiment), the metallic material 2 is allowed to pass through the dies having gradually reducing inner diameter, and thereby being stretched in an axial direction (the direction shown by arrows X in the Figures). Each of the plurality of dies 3 includes a shaped hole 4 which allows metallic material 2 to pass therethrough; the shaped hole 4 is adapted to include a conical-shaped, large-diameter portion 4A that opens upstream in the extending direction and a cylindrical-shaped, small-diameter portion 4B that opens downstream in the extending direction.

Next, in the bending work, while stretching the metallic material 2 in an axial direction by using a bending-stretching mold 5 and a tension unit not illustrated and being located downstream thereof, the metallic material 2 is bent at comparatively small bending radius in an intermediate portion thereof, whereby the metallic material 2 is further stretched. The bending-stretching mold 5 is adapted to include a insertion hole 6 internally bent at an approximate right angle and a feed roller 7 arranged inside of the bending portion of the insertion hole 6. The insertion hole 6 is adapted to include a receiving portion 6A that opens upstream (the left side of FIG. 1) in the extending direction and receives the metallic material 2, and a forwarding portion 6B that opens downstream (the upper side of FIG. 1) in the stretching direction and forwards the metallic material 2 (metal wire 1); the receiving portion 6A and the forwarding portion 6B are arranged intersecting at approximate 90 degrees.

Figure 2A:
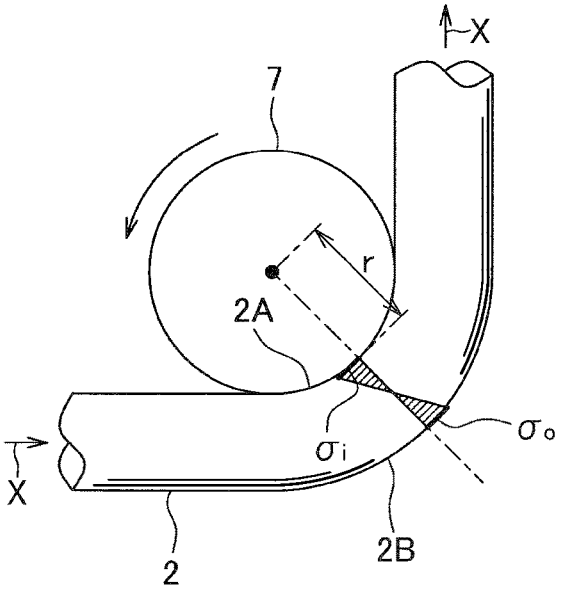
FIG. 2A is a view specifically explaining a manufacturing method of the metal wire.

The feed roller 7 is adapted to be arranged at intersecting portion of the receiving portion 6A and the forwarding portion 6B and is formed to have a diameter commensurate with the bending radius (inner diameter) "r" of the metallic material 2 as shown in FIG. 2A; the feed roller 7 is rotationally driven by a motor or the like as a driving means that is not illustrated. The feed roller 7 forwards the metallic material 2 in an axial direction by assisting a tension unit located downstream of the bending-stretching mold 5. That is, the feed roller 7 applies a frictional force to an inner circumferential surface 2A of a flexural portion on the circumferential surface of the metallic material 2. On the other hand, a frictional force toward forwarding direction is not applied to an outer circumferential surface 2B of the flexural portion of the metallic material 2, while a tension caused by bending is applied thereto. Thus, as for stress $\sigma$ within the cross-section of the metallic material 2 that is bent and extended by the bending-stretching mold 5, stress hysteresis along an axial direction of the stress $\sigma i$ of the inner circumferential surface 2A and the stress $\sigma o$ of the outer circumferential surface 2B differ with each other.

Figure 2B:
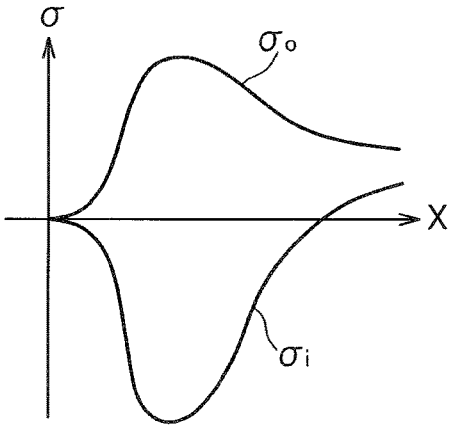
FIG. 2B is a view specifically explaining a manufacturing method of the metal wire.

The stress hysteresis within the cross-section of the metallic material 2 will be described specifically with reference to the conceptual diagram shown in FIG. 2B. Herein, in FIG. 2B, tensile stress is shown in the plus side of the vertical axis and compressive stress is shown in the minus side of the vertical axis. First, the stress $\sigma i$ of the inner circumferential surface 2A once shows a great value of stress at the compression side through the frictional force of the feed roller 7 in addition to a compression force by bending. Such stress hysteresis as gradually increases toward the tensile side is applied thereto through being stretched by the tension unit afterward. On the other hand, although the stress σo of the outer circumferential surface 2B once increases toward the tensile side by bending, subsequently, such stress hysteresis as being in the tensile side at all times while gradually decreasing through being linearly stretched by the forwarding portion 6B of an insertion hole 6 is applied thereto.

Figure 3:
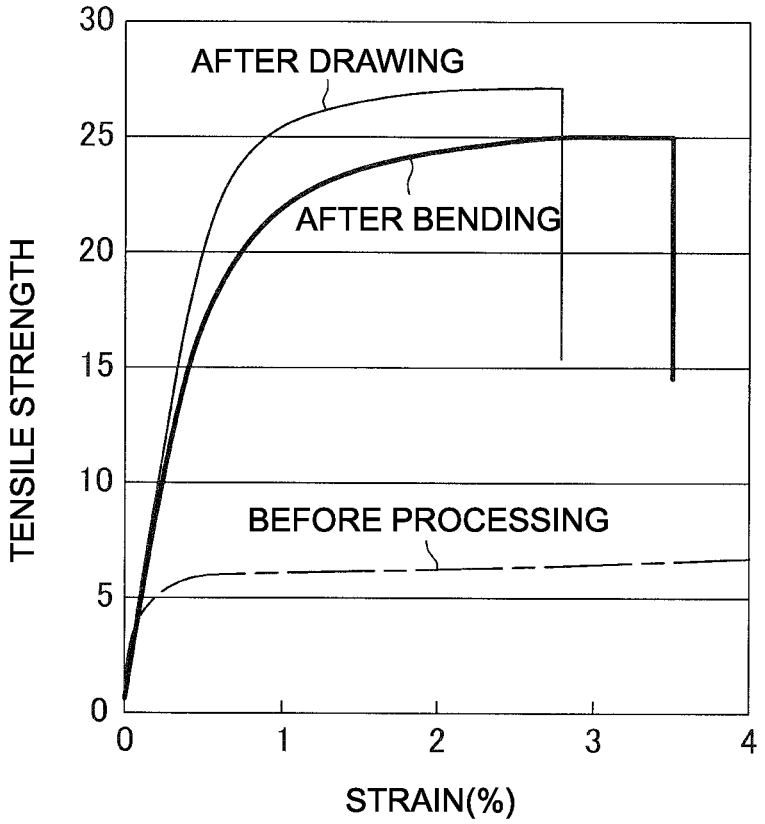
FIG. 3 is a graph showing a mechanical property (mechanical strength-distortion) of the metal wire.

A measurement result of the tensile strength and the hardness distribution within the cross-section of the metal wire 1 processed as the above will be described with reference to FIG. 3, FIG. 4A, and FIG. 4B. Here, in FIG. 3, the graph therein shows the relationship between the tensile strength and distortion, the metallic material 2 before being processed corresponds to dashed line, the metallic material 2 after the drawing and before the bending corresponds to thin solid line, and the metal wire 1 after the bending work corresponds to thick solid line. As shown in FIG. 3, it is observed that both values of the tensile strength of the metallic material 2 (thin solid line) after the drawing and the tensile strength of the metal wire 1 after the bending are drastically increased as compared with the metallic material 2 before processing (dashed line). Also, although the mechanical strength of the metal wire 1 after the bending decreases by approximately 10% as compared with the mechanical strength of the metallic material 2 after the drawing, the breaking strain increases by approximately 30%. Thus, it is observed that the improvement of ductibility is attained as compared with the decrease of the mechanical strength. Here, the metal wire 1 has a hyperfine metallographic structure in which the grain size is equal to or less than 1 μm, thereby obtaining a high tensile strength. Thus, it is observed that the grain size has not changed so much even after the bending.

Figure 4A:
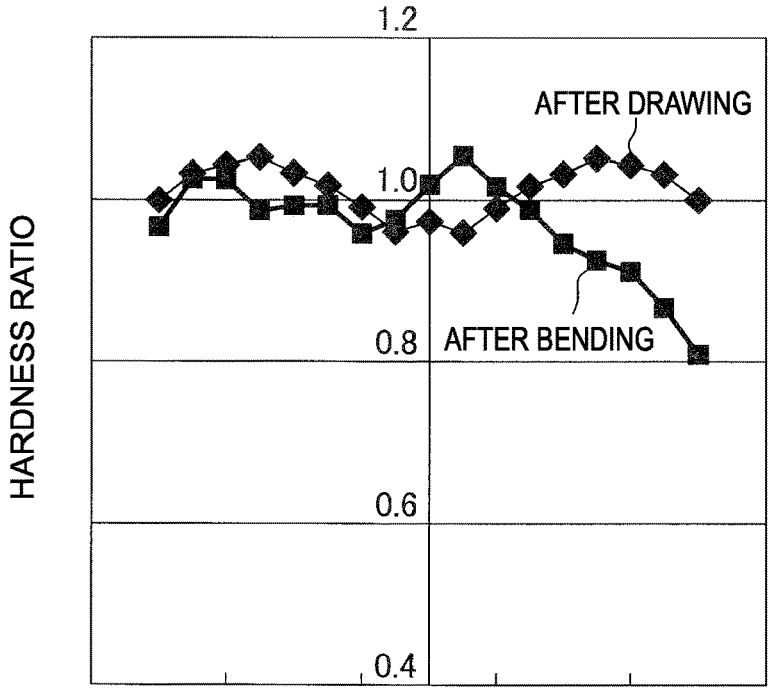
FIG. 4A is a graph showing hardness ratio of the metal wire.
Figure 4B:
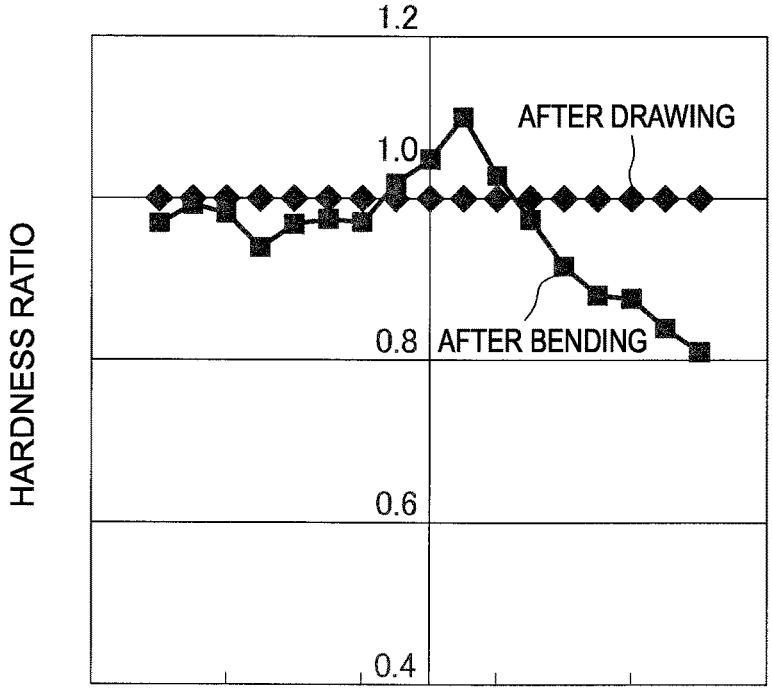
FIG. 4B is a graph showing hardness ratio of the metal wire.

Next, the graph in FIG. 4A and FIG. 4B shows the hardness distribution within the cross-section of the metallic material 2 (rhombus-shape in the Figure) after the drawing and before the bending and the metal wire 1 (quadrilateral-shape in the Figure) after the bending. In FIG. 4A and FIG. 4B, the horizontal axis of the graph therein represents positions in a radial direction of the metallic material 2 and the metal wire 1, the vertical axis of the graph therein represents hardness ratio. Further, in FIG. 4A and FIG. 4B, the hardness ratio of the inner circumferential surface 2A side is shown in the right side of each of the graphs, the hardness ratio of the outer circumferential surface 2B side is shown in the left side of each of the graphs. Here, the specified radial direction of the present invention corresponds to a radial direction connecting the inner circumferential surface 2A and the outer circumferential surface 2B, the radial direction means a radial direction toward the inner circumferential surface 2A. That is, a specific peripheral portion corresponds to a peripheral portion of the inner circumferential surface 2A side. Further, the hardness ratio shown in the graph of FIG. 4A represents values that are obtained from hardness values measured at each of positions and normalized by one hardness value. The hardness ratio shown in the graph of FIG. 4B represents values that are obtained from hardness values measured at each of the positions of the metal wire 1 after the bending (after the secondary processing) and normalized by hardness values of the metallic material 2 after the drawing and before the bending (before the secondary processing) at each of the corresponding positions.

First, referring to the graph shown in FIG. 4A, the hardness distribution of the metallic material 2 after the drawing (before the secondary processing) shows gradual increase of hardness toward the both side of the radial direction from the central portion of the cross-section (center of the horizontal axis of the graph) and shows the maximum value of hardness in the peripheral portion that surpasses the distance of the half of the radius; the hardness distribution shows a bilaterally symmetrical shape with respect to the center of the cross-section and shows harder values in the peripheral portion than in the central portion. On the other hand, the hardness distribution of the metal wire 1 after the bending (after the secondary processing) shows the maximum value of hardness in the central portion of the cross-section, and shows decreased hardness value being downside toward the inner circumferential surface 2A side (the specific peripheral portion side in the specified radial direction, the right side of the graph). The hardness distribution does not show great decrease while gradually decreasing in hardness toward the outer circumferential surface 2B side (an opposing peripheral portion side in the specified radial direction, the left side of the graph) and shows a bilaterally asymmetrical shape with respect to the center of the cross-section. Particularly, it is observed that in the inner circumferential surface 2A side (the specific peripheral portion side) of the metal wire 1 after the secondary processing, a hardness that is decreased by equal to or more than 10% with respect to the hardness of the central portion at the distance of the half of the radius, and hardness that is decreased by equal to or more than 20% with respect to the hardness of the central portion in the circumferential surface portion (the right edge of the graph) are shown. On the other hand, in the outer circumferential surface 2B side (the opposing peripheral portion side), it is understood that the hardness therein fall within plus and minus 10% with respect to the hardness of the central portion.

Next, in the graph of FIG. 4B, comparing the hardness after the secondary processing with the hardness before the secondary processing, it is observed that in the central portion of the cross-section, the hardness shows an increase by approximately 10%, whereas in the inner circumferential surface 2A (the specific peripheral portion side), at the position of ½ of the radius, the hardness shows a decrease by approximately 10% (the hardness ratio of before to after the bending becomes approximately 90%), and at the periphery of the inner circumferential surface 2A side, the hardness shows a decrease by approximately 20% (the hardness ratio of before to after the bending becomes approximately 80%). On the other hand, in the outer circumferential surface 2B side (the opposing peripheral portion side), it is understood that a drastic change of the hardness is not observed and a decrease of the hardness falls within approximately 5% of hardness decrease (the hardness ratio of before to after the bending falls within approximately 95-105%). In view of the above, it has been identified that hardness shows a drastic change between the specific peripheral portion side and the opposing peripheral portion side in the specific radial direction by the bending with the feed roller 7 as aforementioned, thereby achieving a great improvement in the breaking strain while suppressing a decrease of the tensile strength, and obtaining the metal wire 1 having attained an improvement of ductibility. Hence, by manufacturing an electric wire from the metal wire 1 of high ductibility, the breaking of the metal wire 1 can be avoided. Particularly when manufacturing an electric wire from twisted wires, due to the avoidance of the breaking that occurs during twisting, the cost of manufacturing can be reduced with improving the production efficiency of an electric wire and the yield thereof.

The aforementioned preferred embodiments are described to aid in understanding the present invention and variations may be made by one skilled in the art without departing from the spirit and scope of the present invention.

For example, the metal wire 1 of the above embodiments may not be limited to being manufactured by the drawing (primary processing) with a plurarity of dies 3 and the bending (secondary processing) with the bending-stretching mold 5 and the feed roller 7. That is, the drawing may not be limited to the drawing in which the multiple dies 3 is utilized, a drawing in which the metallic material 2 is extended in an axial direction with drawing unit having consecutive insertion holes may also be available. Further, the secondary processing may not be limited to the bending and may be a processing in which the metallic material 2 after the drawing is lineally stretched, or may be a processing in which the metallic material 2 after the drawing is extended while twisting. Furthermore, the hardness of the specific peripheral portion may be decreased by using a proper thermal treatment (e.g., annealing). Further, the materials constituting the metal wire of the present invention may not be limited to copper, copper alloy, aluminum, and aluminum alloy as aforementioned. The materials having crystal structure except for amorphous metals may also be available. In particular, the metal wire having hyperfine metallographic structure with the grain size thereof being equal to or less than 1 μm may be preferable. Moreover, the materials for the metal wire may consist of either single element or a multiple elements, additional elements may be included therein, or the materials for the metal wire may have metallographic structure formed by a secondary phase precipitation or the like.

REFERENCE SIGNS LIST

1 Metal wire
2 Metallic material

The invention claimed is:

1. A metal wire comprising a hardness distribution in which hardness decreases toward a specific peripheral portion in a specific radial direction from a central portion in a cross-section orthogonal to an axis, wherein the metal wire is manufactured at least by subjecting a metallic material to bending at an approximate right angle in an axial direction with a single feed roller of a bending-stretching mold, wherein the bending is subjected only once, wherein the bending-stretching mold includes an insertion hole bent at an approximate right angle, wherein the single feed roller is arranged inside of a bending portion of the insertion hole and applies a frictional force to an inner circumferential surface of a flexural portion on a circumferential surface of the metallic material at the bending portion, wherein the metal wire has a metallographic structure with a grain size equal to or less than 1 μm, wherein a hardness distribution of the specific peripheral portion and another hardness distribution of an opposing peripheral portion that opposes to the specific peripheral portion in a radial direction of the metal wire with reference to the central portion are a bilaterally asymmetrical shape with respect to the center portion in the radial direction of the metal wire, wherein the hardness of the specific peripheral portion decreases by equal to or more than 10% of that of the central portion at a circumferential surface side being beyond at least ½ of the radius from the center, and wherein the another hardness of an opposing peripheral portion falls within plus and minus 10% of that of the central portion, and the another hardness of the opposing peripheral portion is higher than the hardness of the specific peripheral portion.

2. The metal wire according to claim 1, wherein the hardness of the peripheral portion in the radial direction after the extension is higher than the hardness of the central portion, and the hardness of the specific peripheral portion becomes less than the hardness of the central portion by means of a secondary processing performed after the extension.

3. The metal wire according to claim 2, wherein the hardness of the central portion after the secondary processing is higher than the hardness of the central portion before the secondary processing, and the hardness of the specific peripheral portion after the secondary processing decreases by more than 10% with reference to the hardness of the specific peripheral portion before the secondary processing.

4. An electric wire comprising one or more of the metal wire in claim 1.

5. The metal wire according to claim 1, wherein the metal wire is selected from a group consisting of a copper wire, an annealed copper wire made of copper alloy, a tinned copper wire, a nickel-plated copper line, an aluminum wire made of aluminum and an aluminum alloy wire made of aluminum alloy.

6. The metal wire according to claim 1, wherein the frictional force is not applied to an outer circumferential surface of the flexural portion of the metallic material and wherein a tension caused by bending is applied to the outer circumferential surface of the flexural portion of the metallic material.

7. A method for producing a metal wire according to claim 1 comprising steps of:

drawing a metallic material and stretching the metallic material in an axial direction;

bending the metallic material at an approximate right angle in the axial direction;

applying a frictional force of a single feed roller of a bending-stretching mold to an inner circumferential surface of a bent portion of the metallic material;

obtaining a metallographic structure in the metallic material with a grain size equal to or less than 1 μm;

obtaining a first hardness of a first part of the metallic material in a cross section outer than a half of a radius of the metallic material from a center of the metallic material in a radial direction to be equal to or 10% more decreased than that of the center of the metallic material;

obtaining a second hardness of a second part of the metallic material opposing to the first part in the radial direction with respect to the center to be higher than the first hardness and to be within plus and minus 10% of that of the center; and subsequently obtaining the metal wire from the metallic material.

* * * * *